United States Patent [19]

Stofleth et al.

[11] Patent Number: 4,687,686

[45] Date of Patent: Aug. 18, 1987

[54] SPRAY BOOTH WITH CLIMATE REGULATION SYSTEM

[75] Inventors: David F. Stofleth; James H. Muehlbauer, both of Evansville, Ind.

[73] Assignee: George Koch Sons, Inc., Evansville, Ind.

[21] Appl. No.: 792,028

[22] Filed: Oct. 28, 1985

[51] Int. Cl.[4] ..... B05D 1/02

[52] U.S. Cl. ..... 427/421; 118/326; 55/DIG. 46; 98/115.2

[58] Field of Search ..... 118/326; 55/DIG. 46; 98/115.2; 427/421

[56] References Cited

U.S. PATENT DOCUMENTS

| | | | |
|---|---|---|---|
| 4,173,924 | 11/1979 | Bradshaw | 118/326 X |
| 4,258,656 | 3/1981 | Hallgren | 118/326 |
| 4,266,504 | 5/1981 | Roesner | 118/326 X |
| 4,313,369 | 2/1982 | Tsuruta et al. | 118/326 X |
| 4,537,120 | 8/1985 | Josefsson | 55/DIG. 46 X |

FOREIGN PATENT DOCUMENTS

| | | | |
|---|---|---|---|
| 975111 | 11/1982 | U.S.S.R. | 118/326 |

*Primary Examiner*—Shrive P. Beck

*Attorney, Agent, or Firm*—Barnes & Thornburg

[57] ABSTRACT

An apparatus and method is provided for regulating the climate in a spray booth. The spray booth comprises a chamber for housing articles during spray application of a coating material to the articles and an air circulation system for supplying either ambient air or recirculation air to the chamber. The chamber has an outlet for exhausting a contaminated mixture of chamber air and coating material overspray from the chamber. The spray booth further includes a liquid filter for washing the contaminated mixture exhausted through the chamber outlet to wash the coating material overspray out of the mixture. The air circulation system of the improved spray booth includes a system for controlling the temperature of the air supplied to the chamber to regulate the relative humidity of the air in the chamber. The method comprises the steps of exhausting contaminated air consisting essentially of spray booth air and coating material overspray from the spray booth, exposing the exhausted air to liquid to decontaminate the exhausted air for recirculation to the spray booth, lowering the relative humidity of the decontaminated air, and subsequently introducing the decontaminated recirculation air into the spray booth without introducing a large volume of additional outside air so as to regulate the climate in the spray booth.

2 Claims, 1 Drawing Figure

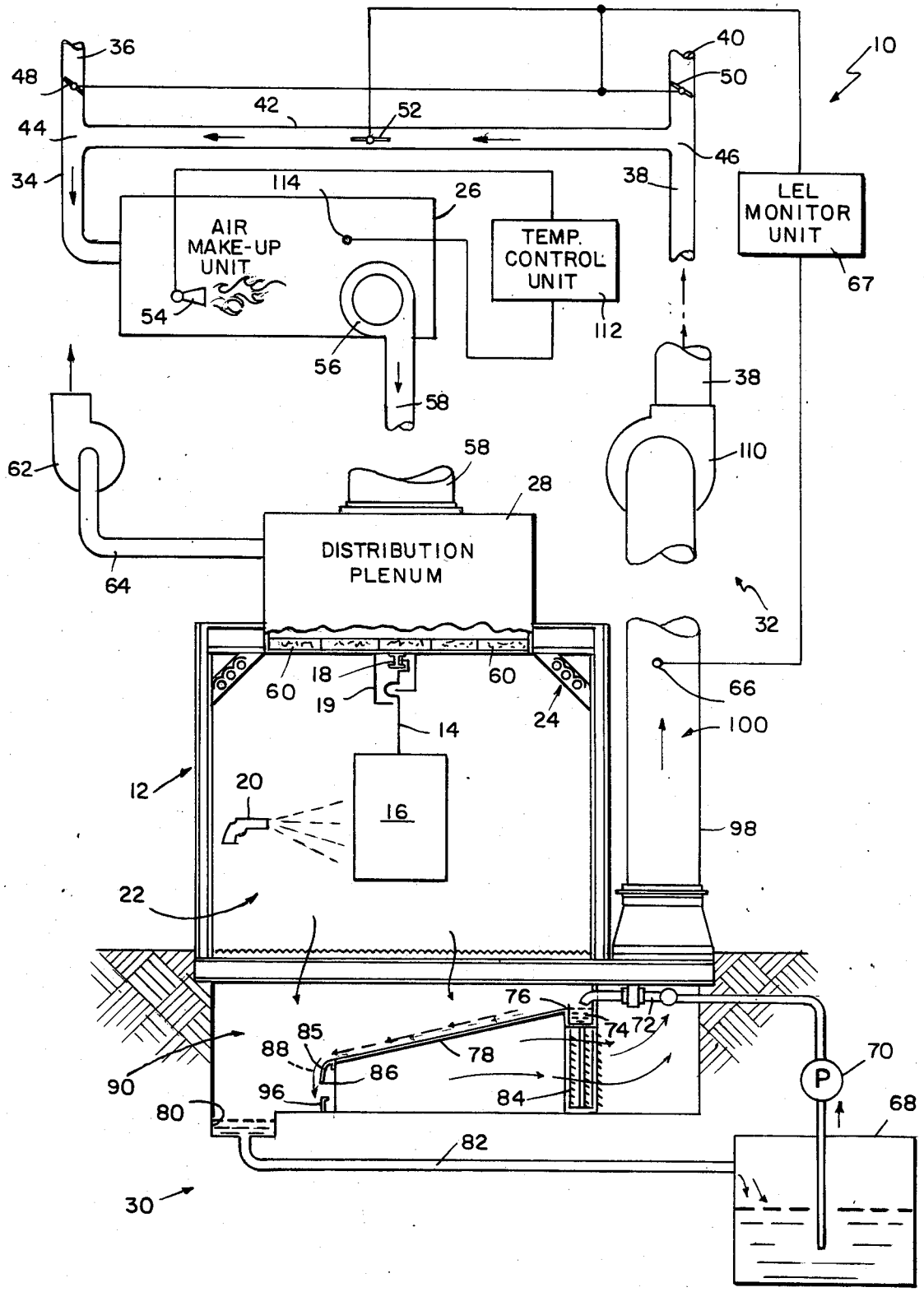
AIR MAKE-UP UNIT
TEMP. CONTROL UNIT
LEL MONITOR UNIT
DISTRIBUTION PLENUM
10
12
14
16
18
19
20
22
24
26
28
30
32
34
36
38
40
42
44
46
48
50
52
54
56
58
60
62
64
66
67
68
70
72
74
76
78
80
82
84
85
86
88
90
96
98
100
110
112
114
P

SPRAY BOOTH WITH CLIMATE REGULATION SYSTEM

This invention relates to systems for spraying a coating material onto articles, and more particularly to an apparatus and method for regulating the climate in a spraying system enclosure.

Various spraying systems for applying a coating material to articles are well known in the art. Most conventional spraying systems include a booth, a spray gun, an air make-up unit for supplying outside air to the booth, and an exhaust system for discharging air contaminated with coating material "overspray" from the booth to the atmosphere. Coating material "overspray" is undeposited material that does not adhere to the articles contained in the spray booth during the spraying operation. In addition, known systems include a filter for filtering the atmosphere of the spray booth to remove and collect the coating material "overspray" thereby decontaminating the air discharged from the spray booth as it is vented to the outside environment.

It is known to use a water curtain to collect and remove coating material overspray entrained in the contaminated air discharged from the spray booth. This water curtain can affect the temperature and humidity ratio of the air discharged from the spray booth to the outside environment.

Heat transfer between the contaminated air discharged from the booth and the water in the water curtain is primarily a function of the water temperature and the air wet bulb temperature, while moisture transfer between the same is primarily a function of the water temperature and the air dewpoint temperature. Regarding heat exchange, if the water temperature is higher than the air's wet bulb temperature in air/water contact, then the water temperature will normally decrease and the air's wet bulb temperature will rise because the water surrenders heat to the air. In contrast, if the water temperature is lower than the air's wet bulb temperature, the water temperature will normally rise and the air's wet bulb temperature will drop because the air surrenders heat to the water. Regarding moisture exchange, the air will be humidified if the water temperature is higher than the final required air dewpoint temperature. In contrast, the air will be dehumidified if the water temperature is maintained below the final required air dewpoint temperature.

Typically, changes in the temperature and humidity of the filtered spray booth air due to exposure to the water curtain do not adversely affect the operation of the spraying system unless the filtered air is recirculated for use in the spray booth instead of being vented to the outside environment. Humidity related problems can significantly impair operation of a waterwash spray booth set up to use recirculated air. In prior air recirculation sprays systems, the relative humidity of the air in the spray booth is maintained at a very high level so that the air is nearly saturated and the temperature of the air in the spray booth is maintained at a low level due to exposure of the recirculation air to the water curtain.

One problem with these systems is that the flowability of moisture-sensitive spray-coating materials such as polyurethane paints is significantly impaired due to the higher relative humidity of the spray booth air. Another problem with prior air recirculation systems is that moisture will condense on the spray gun and on articles contained in the spray booth during the spraying cycle thereby ruining or otherwise damaging the coating material finish of the sprayed article. Condensation occurs on: (1) cold articles entering the spray booth, (2) the spray gun tip, or (3) on any surface having a temperature below the air's dewpoint temperature. The dewpoint temperature of the air is functionally related to the relative humidity of the air. Thus, the air's dewpoint temperature will change relative to a change in humidity due to exposure of the recirculation air to the water curtain.

One technique for decreasing the dewpoint temperature and relative humidity of the air in the spray booth is to decrease the temperature of the water forming the water curtain. Typically, the water that is pumped to form the water curtain remains fairly cool at a temperature between 50° and 60° F. since it is stored in an underground reservoir known as a retention pit or may be cooled by other means. If the water in the water curtain is to be used to limit the amount of moisture in the air steam, the water curtain must always be maintained below the final required air dewpoint temperature. It is possible to increase further the dehumidifying effectiveness of the water curtain by progressively lowering the temperature of the water curtain still further below the air's dewpoint temperature. Attempts to dehumidify the recirculation air by cooling the large volume of water stored in the retention pit to reduce the temperature of the water curtain temperature below the wet bulb temperature of the air are usually costly, inefficient, and a generally undesirable dehumidification technique.

Another technique for decreasing the dewpoint temperature and relative humidity of the air in the spray booth is to bring in enough factory air to mix with the recirculation air so as to reduce the relative humidity of the recirculation air. This is not a practical solution to the relative humidity problem since a very large amount of either heated outside air or building air must be added into the comparatively cooler recirculation air to reduce the relative humidity of the recirculation air and warm the recirculation air to a more comfortable temperature. Generation of such a large volume of additional heated air is a costly undertaking. In addition, such a technique is an inefficient use of energy since it would be necessary to exhaust a large volume of the mixture of heated factory air and recirculation air to maintain the constant volume of air supplied to the spray booth. Typically, a bleed-off exhaust system is located between the air make-up unit and the spray booth to permit exhaustion of a certain amount of air to control the lower explosion level (LEL) in the spray booth. The LEL, of course, is dependent upon the amount of solvents in the spray booth.

One object of the present invention is to regulate the climate of the recirculation air introduced into the spray booth to prevent unwanted condensation of moisture on the spray gun and articles to be sprayed and to improve the flowability of moisture-sensitive coating material.

According to the present invention, the spray booth comprises a chamber for housing articles during spray application of a coating material to the articles and air circulation means for supplying either ambient air or recirculation air to the chamber. The chamber has an outlet for exhausting a contaminated mixture of chamber air and coating material overspray from the chamber. The spray booth further includes liquid means for washing the contaminated mixture exhausted through the chamber outlet to wash the coating material overspray out of the mixture. The liquid means includes a liquid curtain positioned in the path of the exhausted mixture. The liquid curtain collects coating material overspray entrained in the contaminated mixture and discharges substantially uncontaminated recirculation air.

The air circulation means of the improved spray booth includes means for controlling the temperature of the air supplied to the chamber to regulate the relative humidity of the air in the chamber. In preferred embodiments, the temperature controlling means includes heater means for selectively heating the recirculation air introduced into the spray booth without substantially increasing the volume of air introduced into the spray booth. The heater means can be a coil or a gas-fired burner.

Also according to the present invention, a method is provided for regulating the climate in a spray booth. The method comprises the steps of exhausting contaminated air from the spray booth, the contaminated air consisting essentially of spray booth air and coating material overspray, exposing the exhausted air to a liquid to decontaminate the exhausted air thereby providing decontaminated air for recirculation to the spray booth, lowering the relative humidity of the decontaminated air, and subsequently introducing the decontaminated recirculation air into the spray booth without introducing a large volume of additional outside air so as to regulate the climate in the spray booth. It will be appreciated that a small volume of outside air must be introduced into the spray booth to compensate for the small volume of air exhausted by the bleed-off exhaust system to keep the LEL down to a safe level. In preferred embodiments, the relative humidity lowering step can include the step of heating the decontaminated recirculation air without adding a large additional volume of air.

One feature of the present invention is the provision of air circulation means for supplying either ambient outside air or the recirculation air to the chamber. This feature advantageously permits a user to select the desired operating mode using either outside air or recirculation air for introduction into the spray booth. During start-up, it is preferable to introduce outside air into the spray booth and exhaust either contaminated or filtered air from the spray booth directly into the outside environment to purge the chamber in the spray booth of unwanted gases and foreign matter. After a short period of time, it is preferable to activate the recirculation mode so that air is recirculated within the system instead of continually introducing a large volume of fresh outside air and exhausting contaminated or filtered air.

Another feature of the present invention is the provision of means for controlling the temperature of the air supplied to the chamber to regulate the relative humidity of the air in the chamber. In the present invention, the temperature of the air supplied to the chamber is controllable whether the supplied air is outside air or recirculated air. This feature has the advantage of solving the humidity problem in the spray booth by using the cool water supplied from the retention pit to limit the humidity and cool the recirculation air, and then heating the recirculation air to bring the air in the spray booth to a more comfortable temperature and lower relative humidity. Advantageously, the temperature controlling means is positioned in the air circulation means to heat selectively either the outside make-up air or the recirculation air prior to introduction into the spray booth. In addition, this feature makes it unnecessary to lower the temperature of the large volume of water in the retention pit below the wet bulb temperature of the recirculation air to lower the relative humidity of the air in the spray booth.

Yet another feature of the present invention is that the temperature controlling means includes heater means for selectively heating the recirculation air introduced into the spray booth without significantly increasing the volume of air introduced into the spray booth. Thus, the heater means is operable to decrease the relative humidity of the recirculation air prior to introduction of the recirculation air into the spray booth. This feature has the advantage of maintaining the dewpoint temperature and the relative humidity of the air in the spray booth at predetermined levels to reduce the condensation on the spray gun tip and articles contained in the spray booth and to improve application and flowability of moisture-sensitive coating materials to articles contained in the spray booth.

Additional objects, features, and advantages of the invention will become apparent to those skilled in the art upon consideration of the following detailed description of a preferred embodiment exemplifying the best mode of carrying out the invention as presently perceived. The detailed description particularly refers to the accompanying drawing.

An illustrative embodiment of a system for regulating the climate in a spray booth is shown diagrammatically in the drawing. The climate regulation system 10 includes a spray booth or enclosure 12 for at least partially enclosing the spraying operation. Hangers 14 are provided to carry articles 16 to be coated through the booth. Hangers 14 are carried on an overhead track or rail 18, such as an "I" beam conveyor, mounted in the spray booth 12 and are conveyed along the track to position articles 16 within the booth 12 at spaced intervals. Conveyor shields 19 are provided to protect the conveyor from paint overspray. A spray gun 20 or other dispensing means for dispersing coating material in the direction of the articles 16 as they are conveyed through the spray booth 12 is mounted within an interior chamber 22 of the booth. Coating material may be delivered to the spray gun 20 from a source (not shown) of coating material. Lights 24 are positioned in the spray booth 12 to illuminate the spraying activity therein. The climate regulation system 10 further includes an air make-up unit 26 for supplying air to the spray booth 12, a distribution plenum 28, a waterwash filter system 30 for removing coating material overspray from air discharged from the spray booth 12, and an exhaust system 32. The exhaust system 32 is operable either to discharge filtered air to the outside environment or to recirculate the filtered air to the air make-up unit 26 for use in the spray booth 12.

The climate regulation system 10 includes an inlet pipe 34 having an inlet port 36 for admitting ambient, outside air and an outlet pipe 38 having an outlet port 40 for discharging filtered air to the outside surroundings. A recirculation pipe 42 interconnects the inlet and outlet pipes 34, 38 at junctions 44 and 46, respectively, to permit filtered air to be conducted from the exhaust system 32 to the inlet side of the air make-up unit 26. The inlet port 36 and the outlet port 40 are closable by operation of dampers 48 and 50, respectively. The recirculation pipe 42 can be blocked by operation of recirculation damper 52.

Effective operation of a recirculated air spray booth is hampered by humidity-related problems. The recirculation air is generally cooled and humidified due to repeated exposure to a liquid in the waterwash filter system 30. The temperature of the recirculation air is lowered by the waterwash filter system 30 causing the booth chamber 22 to reach an intolerable comfort level and unwanted condensation to occur on: cold articles 16 transported into the booth chamber 22, the tip of the spray gun 20, or on any other surface which is below the air's dewpoint temperature.

In the present invention, means for controlling the temperature of air supplied to the booth chamber 22 is provided to regulate the relative humidity of the air in the booth chamber 22. In particular, the temperature controlling means is used to heat the recirculation air conducted to the air make-up unit 26 via the exhaust system 32. The conventional heating of outside air operates to raise the temperature of the air in the spray booth 12 to a more comfortable level, whereas the novel heating of recirculation air operates primarily to control the relative humidity of the air in the spray booth 12.

In the embodiment shown in the drawing, a heater 54 is positioned in the air make-up unit 26 to heat the air drawn therethrough by supply blower or suction fan 56. The heater 54 can be a coil of the type wherein steam or hot water is circulated through a coiled tube to heat air by convection, a direct gas-fire burner, or any other suitable heater means. The heater 54 operates to warm either: (1) the cool outside air conducted to the air make-up unit 26 via the inlet port 36 and the inlet pipe 34, or (2) the recirculation air exposed to the cool liquid in the waterwash filter system 30 and conducted to the air make-up unit 26 via the exhaust system 32, the recirculation pipe 42, and a portion of the inlet pipe 34 downstream of junction 44.

The distribution plenum 28 receives air from the supply blower 56 via supply conduit 58 and disperses this air throughout the booth chamber 22. A series of filters 60 is positioned in the bottom of the distribution plenum 28 to treat the air discharged from the plenum 28 into the booth chamber 22.

A bleed-off exhaust fan 62 is coupled to the distribution plenum 28 via bleed-off conduit 64 to control the concentration of solvents within the air in the booth chamber 22. Generally, the coating materials used to spray the articles 16 are solvent-based. Thus, a certain amount of solvent is introduced into the booth chamber 22 during spraying activities.

A lower explosion level (LEL) sensor 66 is positioned in the exhaust system 32 as shown in the drawing to sense the solvent concentration level in the filtered air following discharge from the waterwash filter system 30. An LEL monitor unit 67 is coupled to the LEL sensor 66 and also to dampers 48, 50, and 52 as shown in the drawing. The LEL monitor unit 67 actuates dampers 48, 50, and 52 to purge the booth chamber 22 of solvent laden air if the LEL concentration reaches a predetermined set point. Thus, when the solvent concentration is too high, the system switches to conventional operating mode to purge the booth. The bleed-off exhaust fan 62 is operated during operation of the system 10 in recirculation mode to vent a selected small volume of recirculation air to the outside surroundings thereby controlling the LEL in the booth chamber 22.

The waterwash filter system 30 includes a liquid retention pit 68, a pump 70, a liquid supply header 72, an upstream trough 74, a wier 76, an inclined flood sheet 78, a downstream trough 80, and a return pipe 82. Preferably, the retention pit 68 is an underground reservoir filled with a liquid such as water. Liquid stored in an underground reservoir will be kept year-round at a fairly cool uniform temperature of between 50° and 60° F. The liquid in the retention pit 68 is pumped to the liquid supply header 72 by pump 70 and then emptied into the upstream trough 74. The liquid pours over the wier 76 and is deposited onto the downwardly sloping inclined flood sheet 78. The inclined flood sheet 78 includes an arcuate end 85 having a lower edge 86 over which the liquid is cascaded to form a liquid curtain 88 as shown in the drawing. The cascading liquid comprising the liquid curtain 88 is collected in the downstream trough 80 and conducted back to the retention pit 68 by return pipe 82. Moisture eliminator baffles 89 are positioned underneath the upstream trough 74 to condense moisture entrained in the air exposed to the liquid curtain 88 before the air is exhausted from the waterwash filter system 30.

The liquid curtain 88 provides a means for washing the contaminated mxture of spray booth air and coating material overspray to wash the coating material overspray out of the mixture. As shown in the drawing, the contaminated mixture is discharged from the booth chamber 22 into a filter chamber 90 of the waterwash filter system 30 through grating 92 positioned in the bottom of the spray booth 12. The filter chamber 90 has a discharge port 94. The inclined flood sheet 78 is situated to position the liquid curtain 88 in the path of the discharged contaminated mixture as it is conducted toward the exhaust system 32. A vertically adjustable baffle 96 is mounted underneath the lower edge 86 of the inclined flood sheet 78. The adjustable baffle 96 can be raised or lowered to vary the velocity of the flow of contaminated mixture through the liquid curtain 88.

The exhaust system 32 is mounted to the discharge port 94 of the filter chamber 90 for pulling atmosphere within the booth chamber 22 and the filter chamber 90 to either the outside surroundings or the air make-up unit 26. The exhaust system 32 includes an exhaust duct 98 providing an exhaust chamber 100 communicating with the discharge port 94 in the filter chamber 90. A conventional suction fan or blower 110 is coupled to the exhaust duct 98 to pull atmosphere from the booth chamber 22 to the exhaust chamber 100 via the filter chamber 90. In particular, the atmosphere pulled by suction fan 110 is intercepted and treated by the liquid curtain 88 en route to the exhaust chamber 100. The suction fan 110 discharges a substantially uncontaminated mixture from the exhaust chamber 100 into the outlet pipe 38 as shown in the drawing. The dampers 50 and 52 are openable in combination either to exhaust the filtered mixture to the outside surroundings via the outlet port 40 or to recirculate the filtered mixture to the air make-up unit 26 via the recirculation pipe 42.

The system 10 is selectively operable in a conventional exhaust mode or a novel air recirculation mode. Spray application of coating material to articles 16 in the booth chamber 22 can take place regardless of which mode of operation is selected. The conventional exhaust mode is selected to purge the spray booth 12 of solvents or other unwanted foreign materials or gases, while the air recirculation mode is selected to permit a user to regulate the climate in the booth chamber 22 in an efficient manner. In use, the system is generally operated in the conventional exhaust made for the first fifteen or twenty minutes of operation after the system is activated, then recirculation mode is selected for the remainder of the operating cycle.

The conventional exhaust mode is selected by opening dampers 48 and 50 and closing damper 52. In this conventional exhaust mode, the suction fan 56 in the air make-up unit 26 draws outside air into the spray booth 12. The suction fan 110 in the exhaust system 32 draws a contaminated mixture consisting essentially of the newly introduced outside air, solvents or the like, and coating material overspray (if present) past the liquid curtain 88 for discharge to the outside surroundings via outlet port 40.

In contrast, the air recirculation mode is selected by closing dampers 48 and 50 and opening damper 52. It is necessary to exhaust continuously a small volume of air from supply conduit 58 to the outside surroundings via the bleed-off exhaust system 62, 64 to control the lower explosion level (LEL) in the spray booth chamber 22. Inlet damper 48 may be opened slightly to admit a small volume of fresh outside air substantially equivalent to the volume of air discharged by the bleed-off exhaust system 62, 64 to maintain a substantially constant volume of air in the system 10. In the air recirculation mode, the suction fan 56 in the air make-up unit 26 draws recirculation air from recirculation pipe 42 and a small volume of outside air into the spray booth 12 in those cases where it is desirable to control the LEL in the booth chamber 12. The suction fan 110 draws a contaminated mixture past the liquid curtain 88 for recirculation to the air make-up unit 26 via the recirculation pipe 42.

A control unit 112 is provided for selectively activating the heater 54 in the air make-up unit 26 to control the temperature of the air introduced into the booth chamber 22. The control unit 112 activates the heater 54 in response to an instruction from a temperature sensor 114 mounted in the air make-up unit 26 at a point downstream of the heater 54 to sense the temperature of air supplied to the booth chamber 12. In conventional exhaust mode operation, the heater 54 is generally activated to raise the temperature of the air in the booth chamber to a more comfortable level. In contrast, in recirculation mode operation, the heater 54 is activated in response to an instruction from the control unit 112 to add sensible heat to the air in the booth chamber 22, thereby controlling the relative humidity in the booth chamber 22.

In a preferred embodiment, the recirculation air is cooled and humidified due to exposure to the liquid in the liquid curtain since the liquid temperature is lower than air's web bulb temperature. The temperature of the liquid in the underground reservoir 68 will remain constant over a long period of operation and will not change significantly due to contact with air in the filter chamber 90.

The liquid curtain 88 and the heater 54 cooperate to define an air cooling/humidifying and heating cycle. This cycle of cooling and humidifying the recirculation air with the liquid curtain 88 and then heating the recirculation air with heater 54 continues until a thermodynamic equilibrium point is reached. This equilibrium point is a condition where no moisture can be added or removed from the recirculation air as it crosses the liquid curtain 88. At this equilibrium point, the liquid temperature and the recirculation air's dewpoint temperature are equal.

For example, in a test run with a system constructed in accordance with the present invention, the following results were measured. The temperature of the liquid in the retention pit 68 was measured at 54° F., initial air was measured at 72° F. dry bulb, 47% R.H., and the air temperature measured in the exhaust chamber 100 was 62° F. Without using the heater during recirculation mode, the air was measured at 59° F. dry bulb, 95% R.H. after about one-half hour of operation. At this point, the air temperature was still dropping and the recirculation mode had to be deactivated due to the discomfort of the booth operators. In the test case, the heater 54 was activated when the system 10 was operated in recirculation mode to heat the recirculation air to 70° F. dry bulb, 58% R.H. This example illustrates the significant improvement in climate obtainable using the climate regulation 10 of the present invention.

A thermodynamic analysis of the operation of the system 10 shows that during the cooling/humidifying stage of the cycle, the recirculation air's dry and wet bulb temperature decreases and moisture content increases due to exposure to the cool liquid curtain 88. During the subsequent heating stage of the cycle, the recirculation air's dry and wet bulb temperature increases without changing the moisture content. This addition of sensible heat operates to lower the relative humidity of the air introduced into the booth chamber 22 when the system 10 is operated in the recirculation mode. Thus, the relative humidity or percentage of moisture in the air decreases, while the actual quantity of grams of water per pound of dry air stays the same. Regulation of the relative humidity in the booth chamber 22 advantageously reduces condensation on the tip of the spray gun 20 and articles 16 contained in the spray booth 12 and improves application and flowability of moisture-sensitive coating materials to articles 16 contained in the spray booth 12.

Although the invention has been described in detail with reference to certain preferred embodiments and specific examples, variations and modifications exist within the scope and spirit of the invention as described and defined in the following claims.

What is claimed is:

1. A method of operating a spray booth to regulate the climate in a chamber therein during an initial booth start-up mode and a subsequent booth operation mode in which a moisture-sensitive coating material is sprayed onto an article contained in the booth chamber, the method comprising the steps of providing an air make-up unit having heater means for selectively heating air in the air make-up unit, conducting a start-up procedure to ready the climate of the spray booth for article-spraying activities, the start-up procedure comprising the steps of introducing outside air into the air make-up unit, selectively activating the heater means in the air make-up unit to control the temperature of the outside air to be introduced into the booth chamber so that the temperature of air in the booth chamber during the booth start-up mode is at least a predetermined minimum temperature prior to the beginning of an article-spraying activity in the booth chamber, introducing only outside air supplied by the air make-up unit into the booth chamber, drawing a contaminated mixture from the booth chamber, the contaminated mixture consisting essentially of newly introduced outside air, solvents or the like, and coating material overspray not applied to an article during a previous spraying activity, exposing the drawn contaminated mixture to a liquid to decontaminate the drawn contaminated mixture for exhaustion to the atmosphere, and exhausting the decontaminated mixture to the atmosphere for a selected period of time to cleanse the environment within the booth chamber in accordance with a predetermined specification, and subsequently conducting a booth operation procedure to provide and substantially maintain the predetermined specified environment in the booth chamber during article-spraying activities to enhance the quality of finish applied to the article, the booth operation procedure comprising the steps of preventing the introduction of a substantial volume of outside air into the air make-up unit, conducting the decontaminated mixture to the air make-up unit for recirculation to the booth chamber, selectively activating the heating means in the air make-up unit to lower the relative humidity of the recirculation air to be introduced into the booth chamber, introducing only recirculation air supplied by the air make-up unit into the booth chamber, exhausting contaminated recirculation air from the booth chamber, the contaminated recirculation air consisting essentially of air and coating material overspray, exposing the contaminated recirculation air to a liquid to decontaminate the contaminated recirculation air for further recirculation to the booth chamber, and continuing to introduce only the recirculation air into the booth chamber without substantially increasing the volume of air introduced into the booth chamber to regulate the climate in the booth chamber during said spray application, whereby the dewpoint temperature and the relative humidity of the air in the booth chamber are maintained at predetermined levels to reduce condensation on objects contained in the booth chamber and to improve application of the moisture-sensitive coating material to objects contained in the booth chamber.

2. The method of claim 1, further comprising the step of venting a portion of the decontaminated recirculation air into the atmosphere subsequent to the selectively activating step and prior to the introducing step to control the concentration level of solvents in the spray booth, whereby the lower explosion level in the spray booth is controlled.

* * * * *